United States Patent [19]

Young

[11] Patent Number: 4,722,706

[45] Date of Patent: Feb. 2, 1988

[54] TROLLING MOTOR FOOT PEDAL ROLLER BASE

[76] Inventor: Edward W. Young, P.O. Box 30, Mountain Grove, Mo. 65711

[21] Appl. No.: 930,243

[22] Filed: Nov. 13, 1986

[51] Int. Cl.[4] ..... B60L 11/02

[52] U.S. Cl. ..... 440/7; 114/363; 114/153

[58] Field of Search ..... 440/6, 7, 84; 114/144 R, 153, 363; 74/474, 478, 478.5, 512, 564; 297/349, 423, 429, 430, 431, 433, 434–436

[56] References Cited

U.S. PATENT DOCUMENTS

| | | | |
|---|---|---|---|
| 3,151,910 | 10/1964 | Larson | 114/363 |
| 4,008,500 | 2/1977 | Hall, Jr. | 114/363 |
| 4,063,321 | 12/1977 | Nichols | 114/363 |
| 4,597,356 | 7/1986 | McCaghren et al. | 440/7 |

*Primary Examiner*—Joseph F. Peters, Jr.

*Assistant Examiner*—Jesûs D. Sotelo

*Attorney, Agent, or Firm*—Laney, Dougherty, Hessin & Beavers

[57] ABSTRACT

This application relates to a roller base for supporting the foot pedal used to control the operation of a trolling motor, and it includes a pair of spaced foot pedal base plate supporting brackets. The supporting brackets are slidably mounted on an elongated rod for sliding movement along the length thereof. Each of the brackets is apertured to facilitate the securement of the foot pedal base plate thereto. The rod carries, at one of its ends, structure by which the rod can be swivelly or pivotally attached to a vertically extending member secured to the boat carrying the trolling motor to be controlled by the foot pedal. The opposite end of the elongated rod carries a stop element which prevents movement of the outermost of the supporting brackets out of engagement with the end of the rod.

7 Claims, 8 Drawing Figures

TROLLING MOTOR FOOT PEDAL ROLLER BASE

FIELD OF THE INVENTION

This invention relates to a system for controlling the operation of a trolling motor of the type used on fishing boats. More particularly, the invention relates to a roller base assembly adapted to movably support a pivotally mounted foot pedal connected to a trolling motor in order to control its speed and direction.

BRIEF DESCRIPTION OF THE PRIOR ART

U.S. Pat. No. 4,597,356 discloses a roller base constructed to permit a trolling motor foot pedal to be mounted on the roller base. The base is made movable so that the foot pedal can be adjusted in its spacial relationship to a fishing seat occupied by the fisherman, and in the course of controlling the operation of the trolling motor by manipulating the foot pedal with his foot. The roller base assembly shown in this patent is pivotally connected to the pedestal which supports the fisherman's seat in such a way that the roller base assembly can be swung upwardly about a horizontal axis. This is believed to be a detrimental feature because it permits the roller base assembly to bounce at times when the boat upon which it is mounted is pitching in heavy weather, or when it encounters large swells.

To mount the roller base assembly depicted in U.S. Pat. No. 4,597,356 to the pedestal of the fishing seat, it is necessary to remove the fishing seat and then lower a sleeve forming a part of the roller base assembly down over the pedestal. No connection with the pedestal can be effected without such removal of the fishing seat.

Other types of foot pedal supporting assemblies which are operated from a fishing seat are shown in U.S. Pat. Nos. 4,008,500, 4,063,321 and 4,143,436. These systems are relatively complicated and accordingly appear to be more susceptible to malfunctioning or breakage than the supporting assembly of the present invention.

BRIEF DESCRIPTION OF THE PRESENT INVENTION

The present invention provides a roller base assembly for supporting the foot pedal control for a trolling motor. The roller base assembly can be easily de-mounted from the boat and disassembled into a compact collection of parts for storage or packaging for shipment.

Broadly described, the trolling motor foot pedal roller base assembly of the invention includes a pair of foot pedal base plate supporting arms or brackets which are spaced from each other along the length of an elongated slide rod with which each supporting bracket is independently slidably engaged. Each of the supporting brackets may thus be moved longitudinally along the rod independently of the other supporting bracket, and the space between them varied. The two supporting brackets define slots by means of which the base plate upon which a foot pedal for controlling a trolling motor can be secured by means of suitable fastening elements.

The slide rod has an outer end which carries a stop element, such as a cotter key, bolt or the like which functions to stop the sliding movement of the outermost of the two supporting brackets past the outer end of the slide rod so as to become disengaged therefrom.

Each of the supporting brackets carries adjacent the opposite ends thereof, a pair of rollers which are journaled in the brackets for rotation about horizontal axes.

The rollers are aligned for rolling movement along a common plane contacted by the rollers so that the foot pedal control for the trolling motor may be moved from side-to-side with respect to the sides of the boat.

At its end opposite the end which carries the cotter key, or other stop element, the slide rod is adapted to be connected, through a sleeve carried thereon, to either a swivel pin secured to the deck or to a seat pedestal base plate, or optionally to an adapter bracket by which the slide rod and the support brackets carried thereon can be pivotally engaged with the seat pedestal post of a typical fishing seat of the sort conventionally mounted in a bass boat. The adapter bracket can be pivotally connected to the seat pedestal post without removing the seat to facilitate lowering the adapter bracket over the top of the post.

It will be apparent that an important object of the invention is to provide a mechanically simple, yet ruggedly constructed trolling motor foot pedal roller base assembly.

Another object of the invention is to provide a trolling motor foot pedal roller base assembly which can be shifted fore and aft in the boat in which it is used, and also from side-to-side to make the foot pedal actuation more comfortable to the fisherman, and allow the position of the foot pedal to conform more closely to the natural position of the fisherman as he may swivel his seat from side-to-side in the course of fishing.

A further object of the invention is to provide a trolling motor foot pedal roller base assembly which can be installed so as to swing or pivot around the axis of the pedestal post or standard upon which the fisherman's seat is mounted without any requirement for removing or detaching the seat from the pedestal standard.

An additional object of the invention is to provide a trolling motor foot pedal roller base assembly which is adapted to swivel from side-to-side upon a flat floor or deck surface in the course of its usage.

A further object of this invention is to provide a trolling motor foot pedal roller base which can be utilized either by mounting a spike in the floor or deck of a boat about which the roller base assembly can pivotally swivel, or optionally, can be realized by mounting the roller base assembly to a pedestal post or standard upon which the fisherman's seat is supported.

Another object of this invention is to provide a foot pedal roller base assembly which can be pushed in a generally forward direction by gentle foot pressure from the fisherman, so as to adjust the location of the foot pedal to a position of easiest use, but which will retain its thus adjusted position through frictional engagement at a time when the fisherman does not desire for it to move from the location to which it has been pushed.

Important, too, is the realization of the object of providing a unit which supports the foot control pedal of a trolling motor so that that control pedal can be selectively, quickly and easily moved backward and forward and from side-to-side by general foot pressure, but which will retain its position against the rocking and pitching motion of the boat.

Another object of the invention is to provide a supporting structure for supporting a foot pedal control for a trolling motor of the type used in fishing, which supporting structure is adapted for mounting various sizes of foot pedal controls and their supporting plates thereupon.

Additional objects and advantages will become apparent as the following detailed description of the invention is read in conjunction with the accompanying drawings which illustrate certain preferred embodiments of the invention.

GENERAL DESCRIPTION OF THE DRAWINGS

Figure 2:
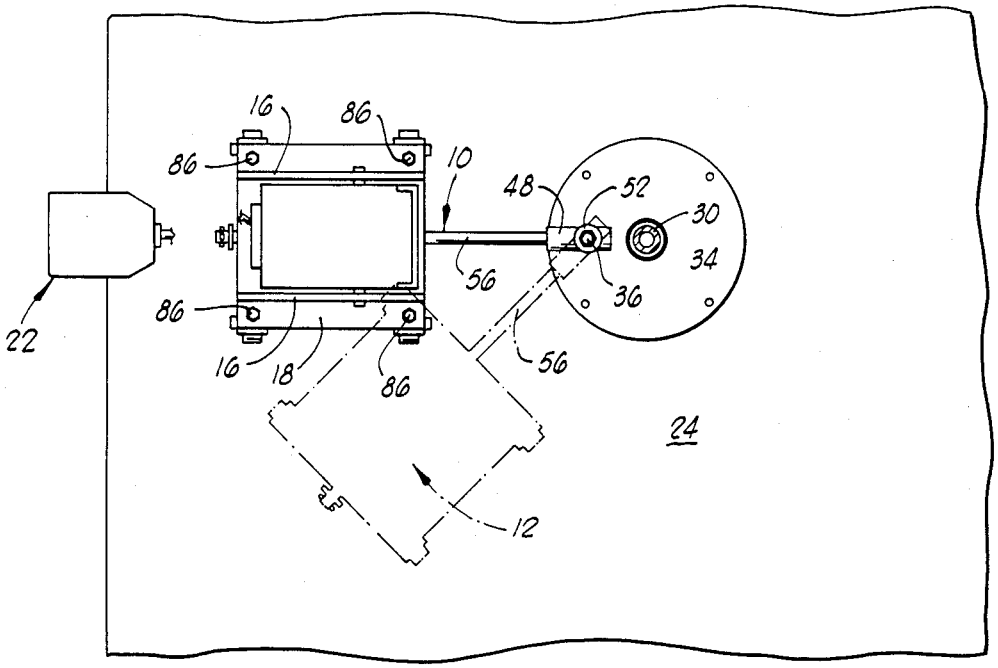
FIG. 2 is a sectional view taken along line 2—2 of FIG. 1, and illustrating, in plan, the trolling motor foot pedal roller base assembly, the trolling motor and a part of the deck of the boat upon which they are mounted.
Figure 3:
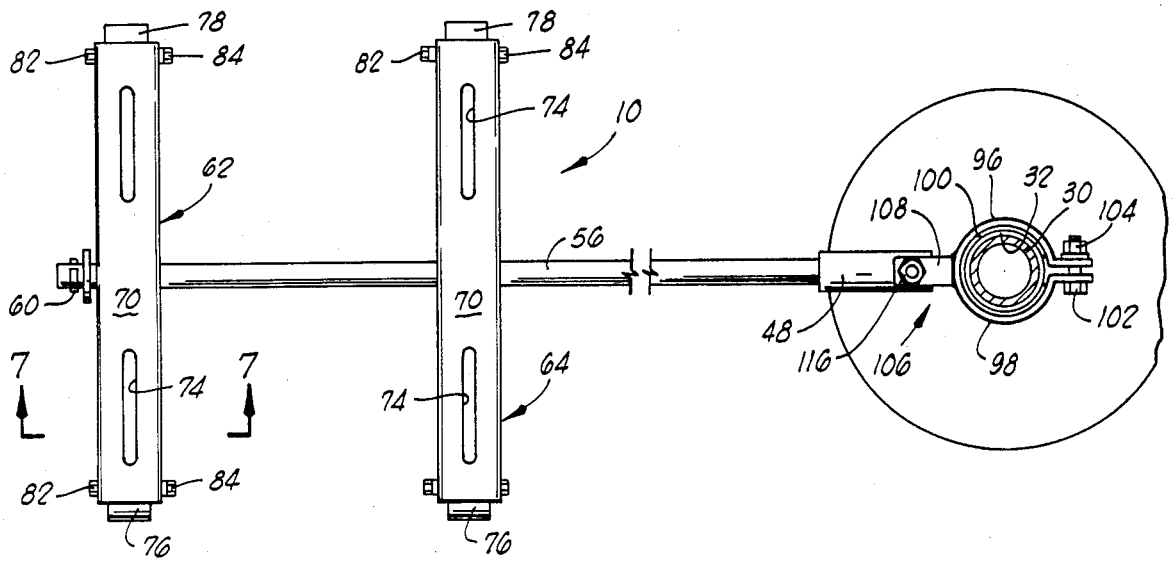

FIG. 3 is a plan view of slightly different embodiment of the trolling motor foot pedal roller base assembly, with the trolling motor foot pedal control removed from the supporting roller base to permit the front and rear supporting brackets thereof to be viewed from above. This alternate embodiment of the invention differs from the embodiment illustrated in FIGS. 1 and 2 by having included therein an adapter bracket by which the roller base assembly can be pivotally connected to the seat pedestal standard or post.

Figure 4:
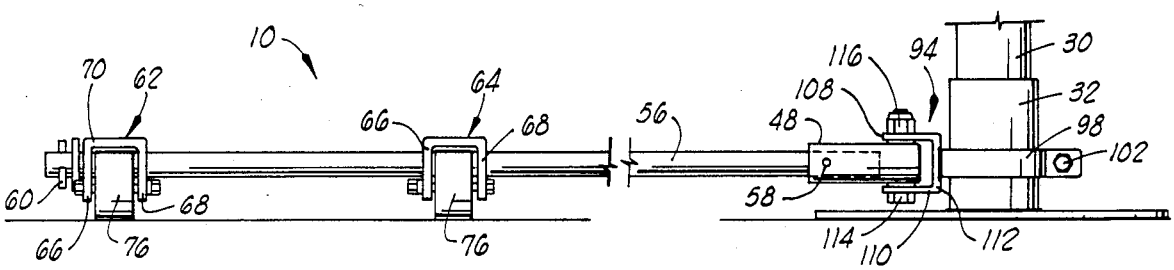

FIG. 4 is a side elevation view of the roller base assembly depicted in FIG. 3.

Figure 5:
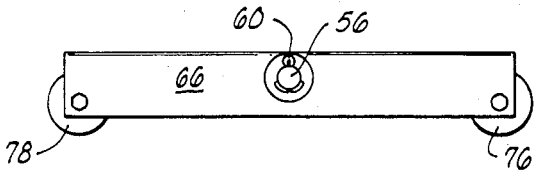

FIG. 5 is an end elevation view depicting the roller base assembly shown in FIG. 3 as it appears when viewed from the outer end thereof looking toward the seat pedestal standard to which the roller base assembly is pivotally connected.

Figure 6:
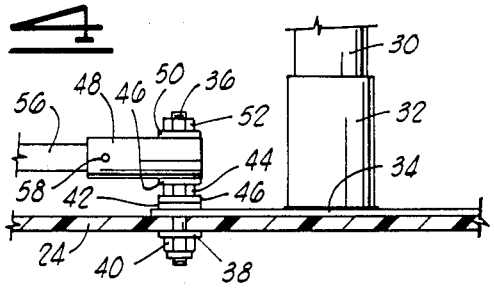

FIG. 6 is a structural detail illustration which shows, in side elevation, the swivel pin utilized to support the roller base assembly for horizontal pivoting movement about a vertical axis through the mounting of the roller base assembly directly onto the boat deck or the seat pedestal base. The boat deck is shown in section.

Figure 7:
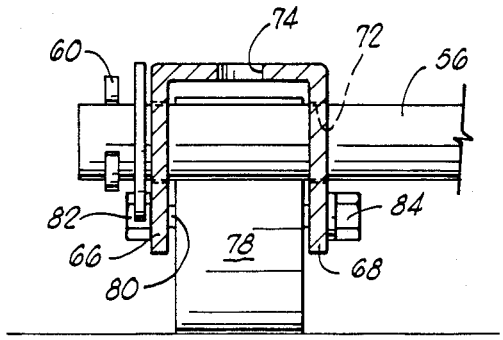

FIG. 7 is a sectional view taken along line 7—7 of FIG. 3 and illustrating the manner in which the supporting brackets are slidably mounted on the slide rod, and illustrating the way the rollers are rotatably mounted in each of the channel-shaped supporting brackets.

Figure 8:
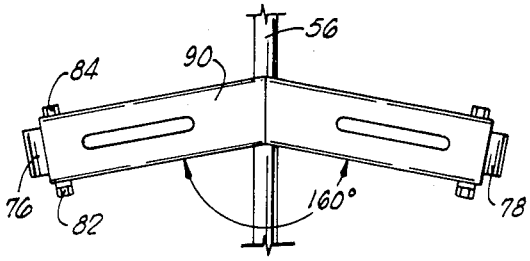

FIG. 8 is a plan view showing an alternate and preferred form of supporting bracket which can be utilized in the roller base assembly of the invention.

DETAILED DESCRIPTION OF A PREFERRED EMBODIMENT OF THE INVENTION

Figure 1:
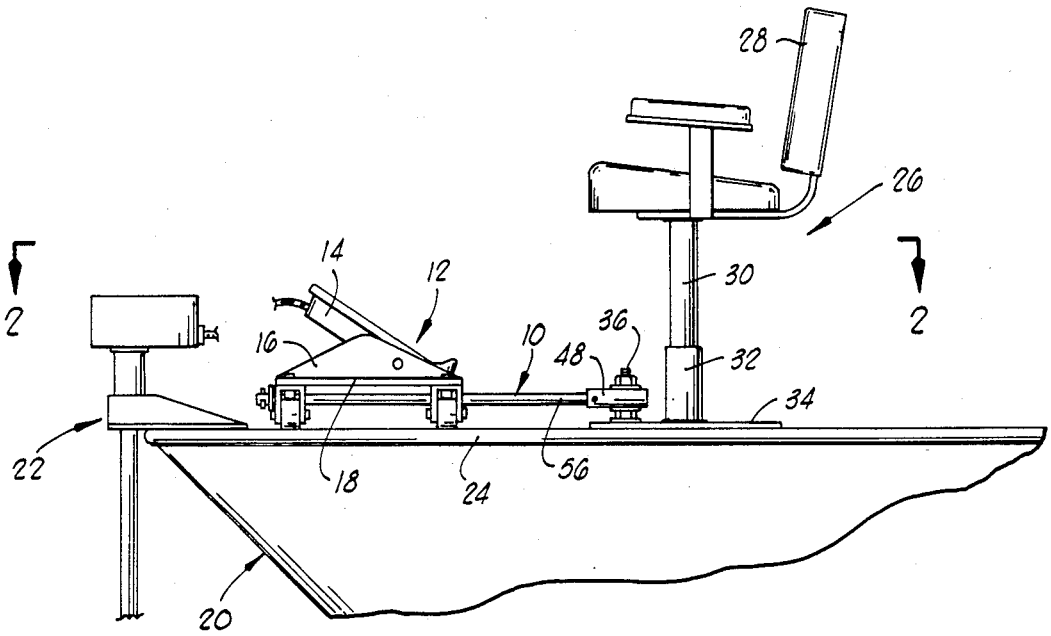
FIG. 1 is a side elevation view of the trolling motor foot pedal roller base assembly of the invention as it appears when mounted on the deck of a base boat adjacent the fisherman's seat and adjacent the trolling motor controlled by the foot pedal.

Referring initially to FIG. 1 of the drawings, shown therein is the trolling motor foot pedal roller base assembly of the invention, which assembly is designated generally by reference numeral 10. The roller base assembly 10 is shown supporting a trolling motor foot pedal assembly 12 which, in conventional fashion, includes a foot pedal 14 pivotally supported between a pair of brackets 16 which are secured to the upper side of a trolling motor foot pedal base or mounting plate 18. The trolling motor foot pedal roller base assembly 10 is supported on the deck of a fishing boat designated generally by reference numeral 20. Mounted on the boat 20 in conventional fashion is a trolling motor 22 which, also in conventional fashion, is connected to, and controlled by, the trolling motor foot pedal assembly 12.

The deck of the fishing boat is denominated generally by reference numeral 24, and is best shown in FIGS. 1, 2 and 6. The deck 24 is substantially flat so as to permit the roller base assembly 10 to roll across the deck in a manner hereinafter described.

Mounted to the upper side of the deck 24 in a conventional fashion is a fishing chair assembly designated generally by reference numeral 26. The fishing chair assembly 26 includes a fishing chair 28 which is pivotally mounted on the upper end of a vertically extending pedestal, post or standard 30. The post or standard 30 can typically be pivotally received within a vertically extending sleeve 32 which is welded or otherwise suitably secured to the upper side of a seat pedestal base plate 34.

In the embodiment of the roller base assembly 10 which is depicted in FIGS. 1 and 2, the roller base assembly is shown in the form by which it is specifically adapted for mounting either to the seat pedestal base plate 34, as shown in FIGS. 1 and 6, or directly to the deck 24 of the boat. To accomplish such mounting, a swivel pin 36 is mounted through the seat pedestal base plate 34 and deck 24 in the manner best illustrated in FIGS. 1 2, and 6, and projects vertically through the deck and base plate. The swivel pin is held in position by means of washers 38 and a nut 40 secured to the threaded lower end of the pin, and by means of spacer washer 42 and a locking nut 44 secured around the swivel pin between a pair of flat washers 46 as shown in FIG. 6. The upper end portion of the swivel pin 36 is extended through a diametric aperture (not shown) formed through a generally cylindrical horizontally extending sleeve 48, and is retained in engagement with the sleeve by means of a flat washer 50 and cap nut 52. The sleeve 48 is thus engaged with the swivel pin 36 for horizontal pivoting of the sleeve about a vertical axis.

An elongated, horizontally extending slide rod 56 has one of its ends projected into the sleeve 48 and is engaged with the sleeve by means of a set screw 58 or other fastening element. The slide rod 56 is a solid bar, and is enabled to swing or pivot in a horizontal plane by reason of the pivotal attachment of the sleeve 48 to the swivel pin 36. At its end opposite the end engaged with the sleeve 48, the slide rod 56 has a transverse aperture formed therethrough for a purpose hereinafter described.

A pair of elongated, channel-shaped supporting brackets 62 and 64 are slidably mounted on the slide rod 56 so that the longitudinal axis of each of the supporting brackets extends normal to the longitudinal axis of the slide rod. Each supporting bracket can thus slide on the slide rod 56 toward one or the other end thereof. As shown in FIGS. 1 and 7, each of the supporting or mounting brackets 62 and 64 is of an inverted channel or U-shaped configuration in cross-section, and thus includes a pair of parallel, downwardly extending flanges 66 and 68 and an interconnecting, horizontally extending web portion 70. Each of the flanges 66 and 68 define a circular aperture 72 at a central location therealong in order to permit the slide rod 56 to be extended slidably therethrough, as shown in FIG. 7. The web portion 70 of each channel-shaped supporting brackets defines a pair of horizontally spaced, elongated slots 74 which are positioned adjacent opposite ends of the respective supporting bracket and on opposite sides of the slide rod 56.

At the opposite end of each of the supporting brackets 62 and 64, each bracket carries a pair of rollers 76 and 78. Each roller 76 and 78 is rotatably mounted in the respective supporting bracket for rotation about a horizontal axis. Thus, each roller 76 and 78 is supported upon a headed bolt 80 which is projected through aligned apertures (not visible) in the two parallel flanges 66 and 68 of the respective supporting bracket. Each bolt 80 is retained in position by means of the head 82 and a nut 84 which is threaded onto the opposite end of the bolt.

In mounting the foot pedal assembly 12 upon the roller base assembly 10, the base or mounting plate 18 of the foot pedal control assembly 12 is abutted flatly against the upper sides of the supporting brackets 62 and 64, and apertures formed through the mounting plate are aligned with the slots 74 formed through the web portion 70 of each of the mounting brackets. Suitable fastening elements 86 are then extended through the aligned holes and slots so as to secure the foot pedal control assembly 12 to the two supporting brackets 62 and 64. The foot pedal 14 will, of course, be aligned with the longitudinal axis of the slide rod 56 to facilitate operation by the foot of the fisherman.

In the use and operation of the roller base assembly of the invention, the assembly is manipulated by the fisherman while he is sitting in the fishing chair 28 with one foot upon the foot pedal 14. Without distracting from the fishing in progress, the fisherman can cause the foot pedal control assembly 12 to be easily repositioned to a location where there is no physical strain to keep the foot in contact with the foot pedal 14, and thereby control the speed and direction of the trolling motor 22 at all times. The roller base assembly 10 can be caused to swing from side-to-side as the rollers 76 and 78 track along the upper surface of the deck 24 of the boat. Further, the foot pedal control assembly 12 can be slid outwardly along the slide rod 10 in the event the fisherman wishes to adjust its position in correlation to his height and the length of his legs.

In a preferred embodiment of the invention, each supporting bracket is changed from the geometric configuration which characterizes such brackets 62 and 64 as shown in FIGS. 3, 4 and 5, to the angled configuration depicted in FIG. 8. In the angled configuration of FIG. 8, the supporting bracket 90 defines a centrally disposed angle located in the center of the bracket, with the bracket subtending an angle of from about 140° to about 170°, with 160° being the most preferred angle. Stated differently, each arm of the bracket 90 preferably defines an angle of 10° with a line extended normal to the longitudinal axis of the slide rod 56. When angled support brackets 90 of the type shown in FIG. 8 are utilized, this locates the axles 80 of the rollers 76 and 78 more nearly upon the turning radius of the roller base assembly as it undergoes pivoting movement about the swivel pin 36. The rollers 76 and 78 therefore track more easily from side-to-side without skewing or scuffing along the deck.

It should be pointed out that instead of providing an angle in the supporting brackets as shown in FIG. 8, each supporting bracket may be constructed in an arcuate configuration conforming substantially to an arc of a circle so as to locate the pivotal axes of the rollers 76 and 78 in substantially the same location as is characteristic of their location when mounted upon one of the angled supporting brackets 90 of the type shown in FIG. 8. An alternate embodiment of the invention is depicted in FIGS. 3 and 4. In such embodiment, the roller base assembly 10 is connected to the sleeve 32 forming a part of the fishing chair assembly chair 26, instead of to a swivel pin 36 connected to the deck 24 or seat pedestal base plate 34. Where the roller base assembly 10 is connected to the sleeve 32, such connection is accomplished by means of an adapter bracket assembly designated generally by reference numeral 94. The bracket assembly 94 includes a split-jawed clamp which has a pair of generally semi-circular, circular, cooperating arcuate clamp jaws or bands 96 and 98 which extend around, and enclose, a plastic split liner 100. The plastic split liner or bushing 100 is dimensioned and configured to afford some accommodation of and, universality in, the sizes of fishing chair assembly sleeves, corresponding to the sleeve 32, which can be grippingly engaged by the bracket assembly.

The clamp jaws 96 and 98 and the plastic split liner 100 can be opened apart enough to permit them to be extended around the sleeve 32. The jaws 96 and 98 can then be drawn together by means of a locking screw 102 engaged by nut 104. This serves to draw the split clamp tightly around the sleeve 32.

Secured to one side of the split clamp is a U-shaped clevis 106. The U-shaped clevis 106 includes a pair of horizontally extending legs 108 and 110 which are joined by a web portion 112. The web portion 112 is welded or otherwise suitably secured to the outer (closed) side of the split clamp. The two clevis legs, 108 and 110, define a pair of vertically aligned openings which receive a pivot pin 114 secured in place by means of the nut 116. The pivot pin 114 is passed through the same passageway through the sleeve 48 as that which accommodates the swivel pin 36 in the embodiment of the invention illustrated in FIGS. 1, 2 and 6.

The embodiment of the invention depicted in FIGS. 3 and 4 operates in substantially the same way as that which has been previously described in referring to the embodiment shown in FIGS. 1, 2 and 6. Thus, after the foot pedal control assembly 12 has been secured to the upper sides of the supporting brackets 62 and 64, the position of the foot pedal control assembly in relation to the fishing chair 28 can be easily adjusted by sliding the brackets 62 and 64, along with the supported foot pedal control assembly 12, axially along the length of the slide rod 56. After this adjustment is made, the device can be utilized while fishing by swivelling the roller base assembly from side-to-side as the rollers 76 and 78 roll across the surface of the deck.

With respect to the embodiment of the invention shown in FIGS. 3 and 4, it is important to note that the roller base assembly can be engaged with the sleeve 32 of the fishing chair assembly 26 without the necessity for removing the fishing chair 28 from the pedestal or standard 30, or the fishing chair 28 and standard 30 from the sleeve 32. Thus, the device can very quickly be secured in an operative position, even while someone is sitting in the fishing chair 28, if this should be desired.

It is also important to note that in all forms of the roller base assembly 10, the elongated slide rod 56, though pivotal about a vertical axis by movement in a substantially horizontal plane, is restrained against upward (vertical) pivoting movement, and thus violent pitching motions of the boat do not have the effect of causing the supporting bracket 62 and 64 and the foot pedal control assembly 12 carried thereon to bounce up and down on the boat deck 24.

From the foregoing description it will be perceived that the present invention provides a relatively simply constructed, yet versatile, roller base assembly 12 for supporting a foot pedal control assembly on the deck of a fishing boat. The roller base assembly 12 can be quickly attached either to a swivel pin mounted through the deck of the boat, or through the base plate provided as a part of the fishing seat pedestal, or the roller base assembly can be connected, through an adapter assembly, to the pedestal or stanchion which supports the seat, or to a sleeve in which the seat pedestal or post is supported. The roller base assembly 12 can swivel across the deck through a certain limited arc, particularly when it is connected to the sleeve forming a part of the fishing seat assembly. Thus, in this latter embodiment, the roller base assembly is prevented from swivelling through more than about 200°, and thus cannot swivel all the way around to a position where it can roll off of a raised or raked deck which is characteristic of some types of fishing boats at the location where the fishing chair is mounted.

It will be perceived that the entire assembly can be broken down quickly and easily into several small parts, and that those parts can be compactly stored or packaged after such break down.

Although certain preferred embodiments of the invention are herein described, it will be understood that various changes can be made in the illustrated embodiments without departure from the principles upon which the invention is based. Changes of this type which do not depart from such basic principles are therefore deemed to be circumscribed in the spirit and scope of the invention, except as the same may be necessarily limited by the appended claims, or reasonable equivalents thereof.

What is claimed is:

1. A roller base assembly for rollably supporting a trolling motor foot pedal control comprising:

an elongated slide rod;

a pair of spaced, substantially horizontally extending supporting brackets adapted to support said foot pedal control, and each slidably mounted on said slide rod for slidingly moving in an axial direction therealong;

rollers carried on each of said supporting brackets and facilitating rolling movement in an arc having a tangent which extends normal to the longitudinal axis of said slide rod;

stop means detachably carried on one end of said slide rod to prevent said supporting brackets from sliding off of said one end of said slide rod during the use of said rollers base assembly, but permitting quick removal on said supporting brackets from said slide rod when it is desired to break down said roller base assembly for compact storage;

a sleeve secured to the other end of said slide rod, said sleeve defining a vertically extending pin-receiving aperture extending normal to the longitudinal axis of said slide rod, and said pin-receiving aperture dimensioned and positioned for mounting said rod and supporting brackets upon a deck-mounted, vertical pin for pivoting about a vertical axis.

2. A roller base assembly as defined in claim 1 wherein each of said elongated supporting brackets has its opposite ends and its center positioned at points located on an arc of a circle, and each of said brackets has one of said rollers rotatably mounted on each of its opposite ends, and has said slide rod extending through said center of the respective bracket.

3. A roller base assembly as defined in claim 1 wherein each of said elongated supporting brackets is bent at its center to define an obtuse angle of from about 140° to about 170° between the opposite end portions of the respective bracket whereby the rollers carried on each bracket can more easily roll in a lateral, cross-deck direction.

4. A roller base assembly as defined in claim 1 and further characterized as including an adapter bracket assembly adapted for attaching said sleeve to a vertically extending structure and comprising:

a split clamp open at one side and including a pair of opposed, flexibly interconnected jaws dimensioned to engage said vertically extending structure by clamping action;

a clevis carried on said clamp on the opposite side thereof from said open side; and a vertically extending pivot pin detachably mounted in said clevis for extension in a direction parallel to said post, said pivot pin extending through said sleeve aperture to support said slide rod and the horizontally extending supporting brackets slidably mounted thereon for horizontal pivotation about a vertical axis.

5. A roller base assembly as defined in claim 4 wherein each of said elongated supporting brackets has its opposite ends and its center positioned at points located n an arc of a circle, and each of said brackets has ne of said rollers rotatably mounted on each of its opposite ends, and has said slide rod extending through said center of te respective bracket.

6. A roller base assembly as defined in claim 1 and further characterized as including:

a vertically extending swivel pin extending through said pin receiving aperture for pivotally supporting said sleeve, rod and supporting bracket for horizontal pivoting about a vertical axis; and means for securing said swivel pin to a boat deck with said sleeve spaced above said deck.

7. A roller base assembly as defined in claim 1 wherein each of said supporting brackets is an elongated, inverted channel which receives said rod through the center thereof and which includes:

a web portion on the upper side thereof and including spaced slots formed therethrough;

a pair of spaced parallel flanges extending downwardly from opposite edges of said web portion; and wherein a pair of said rollers are journalled between said flanges.

* * * * *

UNITED STATES PATENT AND TRADEMARK OFFICE

CERTIFICATE OF CORRECTION

PATENT NO. : 4,722,706

DATED : February 2, 1988

INVENTOR(S) : Edward W. Young

It is certified that error appears in the above-identified patent and that said Letters Patent are hereby corrected as shown below:

In Column 3, Line 10, delete the word "base" and insert -bass-.

In Column 4, Line 42, after the words "formed therethrough" insert -to enable a cotter key 60 to be removably extended therethrough-.

In Column 6, Line 5, after the word "semi-circular," delete the word "circular".

In Column 7, Line 48, delete the word "rollers" and insert -roller-.

In Column 8, Line 35, after the word "located" delete "n" and insert -on-.

In Column 8, Line 36, delete "ne" and insert -one-.

In Column 8, Line 37, delete "te" and insert -the-.

Signed and Sealed this

Second Day of August, 1988

*Attest:*

*Attesting Officer*

DONALD J. QUIGG

*Commissioner of Patents and Trademarks*